US007014069B2

(12) United States Patent
Crosnier et al.

(10) Patent No.: US 7,014,069 B2
(45) Date of Patent: Mar. 21, 2006

(54) DOSAGE PUMP

(76) Inventors: Daniel Crosnier, 14, rue Jacques-Lanty, F-76550 Offranville (FR); Jean-Marie Dulery, 52, avenue Pierre Semard, F-94210 La Varenne Saint Hilaire (FR)

( * ) Notice: Subject to any disclaimer, the term of this patent is extended or adjusted under 35 U.S.C. 154(b) by 0 days.

(21) Appl. No.: 10/479,297

(22) PCT Filed: May 30, 2002

(86) PCT No.: PCT/FR02/01814

§ 371 (c)(1),
(2), (4) Date: Jun. 21, 2004

(87) PCT Pub. No.: WO02/096776

PCT Pub. Date: Dec. 5, 2002

(65) Prior Publication Data

US 2004/0251280 A1 Dec. 16, 2004

(30) Foreign Application Priority Data

Jun. 1, 2001 (FR) ..... 01 07222

(51) Int. Cl.
*B65D 88/54* (2006.01)

(52) U.S. Cl. ..... 222/321.9; 222/321.7

(58) Field of Classification Search ..... 222/321.7, 222/321.9, 383.1, 383.3, 321.2, 385; 239/333
See application file for complete search history.

(56) References Cited

U.S. PATENT DOCUMENTS

| | | | | |
|---|---|---|---|---|
| 3,237,571 A * | 3/1966 | Corsette | 417/513 |
| 3,331,559 A | 7/1967 | Fedit et al. | |
| 4,606,479 A * | 8/1986 | Van Brocklin | 222/321.2 |
| 5,458,289 A * | 10/1995 | Cater | 239/119 |
| 5,704,519 A | 1/1998 | Crosnier et al. | |
| 6,050,457 A * | 4/2000 | Arnold et al. | 222/321.9 |
| 6,340,102 B1 * | 1/2002 | Su | 222/321.2 |

FOREIGN PATENT DOCUMENTS

| | | |
|---|---|---|
| EP | 0 737 519 A2 | 10/1996 |
| FR | 1 441 127 A | 12/1966 |

* cited by examiner

*Primary Examiner*—Frederick Nicolas
(74) *Attorney, Agent, or Firm*—Baker & Daniels LLP

(57) ABSTRACT

A dosage pump which includes a pump body and a control means with rest and distribution positions. The control means includes a dosing chamber, a return spring, and a member to ensure friction braking of the sliding movement of the actuating members of the pump.

5 Claims, 5 Drawing Sheets

DOSAGE PUMP

BACKGROUND OF THE INVENTION

The present invention relates to a metering pump, designed to be mounted by means of a screw, snap-fit, welded connection, etc., on various rigid or flexible receptacles such as bottles, tubes or pots, in particular receptacles containing cosmetic or pharmaceutical products or alternatively food products, of different viscosities which may range from liquid products to products with a creamy consistency.

Different types of metering pumps have been on the market for a number of years, all of which require the use of a certain number of parts such as springs, bearings, valves, stoppers and others. The main disadvantage of such pumps is that they are made up of a number of parts and the cost of manufacturing and assembling these parts is high.

In order to remedy these disadvantages, metering pumps have already been proposed, which comprise a pump body which can be adapted to fit a receptacle and communicates with the internal part of the latter, as well as control means, cooperating with the pump body to define a metering chamber, which can be operated from the exterior so as to be displaced between a dispensing position and a non-operating position to enable a metered quantity of product to be ejected from the metering chamber to the exterior via an ejection orifice and then transfer a new metered quantity of product from the receptacle to the metering chamber and so on.

With this design known from the prior art, the control means are elastically returned from the dispensing position to the non-operating position once they are longer subjected to an external constraint, in order to create a vacuum pressure so that a metered quantity of product can be drawn towards the metering chamber.

In spite of their undeniable specific properties, the disadvantage of such metering pumps is that they are often relatively expensive.

The objective of the present invention is to overcome these drawbacks by proposing a simple, efficient and reliable metering pump, which is also remarkably inexpensive to manufacture.

SUMMARY OF THE INVENTION

To this end, the invention relates to a metering pump of the type outlined above, characterised in that the control means are provided in the form of:

- a push button with an ejection orifice and designed to slide in the pump body,
- a plunger essentially in the form of a tubular body mounted on the internal part of the push button and cooperating with the pump body to define the metering chamber,
- operating elements designed to slide along the pump body as a unit with the push button,
- a return spring mounted between the pump body and the push button outside the metering chamber and
- means for braking, by means of friction, the sliding motion of the operating elements along the pump body.

For the purposes of the invention, the control means have guide elements cooperating with the operating elements to enable the metering chamber to be placed in communication with the ejection orifice or with the internal part of the receptacle.

The operating elements are also independent of the push button in the non-operating position but move into to contact with it in the dispensing position as the control elements are displaced between these two positions.

As a result of another characteristic feature of the invention, the operating elements have a shoulder on their external face, forming a stop intended to co-operate with a matching shoulder on the internal face of the push button or an element joined to it in order to join these elements as they are displaced in translation along the pump body.

For the purposes of the invention, the control elements are so designed that, starting from the non-operating position in which the metering chamber containing a dose of product is in communication with the internal part of the receptacle but is isolated from the ejection orifice, the control means are moved into the dispensing position in two stages, namely, a first stage on the one hand, during which the push button slides inside the pump body independently of the operating elements so as to isolate the metering chamber from the internal part of the receptacle as this chamber is being placed in communication with the ejection orifice, and a second stage on the other hand, during which the push button and the operating elements slide as a unit inside the pump body, and the piston compresses the product disposed in the metering chamber so that it can be ejected through the ejection orifice to the exterior.

Conversely, starting from the dispensing position in which the metering chamber contains no product and communicates with the ejection orifice but is isolated from the internal part of the receptacle, the return spring automatically returns the control means to the non-operating position and does so in two stages, namely, a first stage on the one hand, during which the push button slides inside the pump body independently of the operating elements to as to place the metering chamber in communication with the internal part of the receptacle and isolate the metering chamber from the ejection orifice, and, on the other hand, a second stage during which the push button and the operating elements slide as a unit inside the pump body, creating a vacuum pressure so that a metered quantity of product is drawn towards the metering chamber and is so once the two shoulders acting as a stop come into contact.

As a result of another feature of the invention, the plunger has a connecting orifice pierced through its body and designed to be placed in communication with the metering chamber and with the ejection orifice.

If the metering pump is intended for dispensing liquid products such as perfumes or toilet waters, the connecting orifice may advantageously be linked to a swirl system provided in the internal part of the plunger body and designed to co-operate with the ejection orifice to permit vaporisation and atomisation of this liquid product to the exterior.

Clearly, if the metering pump is intended as a means of dispensing more viscous products such as lotions or creams, the plunger body will not be fitted with such a swirl system.

In a first embodiment of the invention, the operating elements are the actual plunger itself.

This first embodiment is specifically used in the manufacture of promotional samples or mini-metering pumps, known as "spray mini-pumps", in particular for handbags and as a means of spraying perfume, toilet water, etc. . . .

In this first embodiment, the push button has an essentially cylindrical median end-piece on its internal part, surrounded by an annular recess to accommodate the top end of the plunger body.

This median end-piece has a circular sealing rib at its periphery, which moves into abutment with the internal face of the plunger body in order to isolate the metering chamber from the connecting orifice, whilst its bottom end has a locating pin acting as a seat for an annular seal provided on the top of a hollow median rod and fixed coaxially on the internal face of the plunger body in order to isolate the metering chamber from the internal part of the receptacle.

By virtue of another feature of this first embodiment, the metering chamber is bounded at its top part by the internal face of the plunger body and the external face of the median rod thereof and is designed so that it can be placed in communication with the connecting orifice and the ejection orifice or with the internal part of the receptacle via a dispensing orifice pierced through the top face of the latter and connecting with a longitudinal dispensing groove provided in the internal wall of the plunger body.

As a result of another feature of this first embodiment, the ejection orifice is closed off by the body of the plunger in the non-operating position.

This feature is of particular advantage because it protects any product "waiting" between the metering chamber and the ejection orifice, which is quite important in terms of delaying oxidation in the case of certain delicate products (perfumes, lotions, . . . ).

In a second embodiment of the invention, the plunger forms a unit with the push button and the operating elements are provided in the form of a nozzle with a tubular body closed at its top end and open at its bottom end so that it can be placed in communication with the internal part of the receptacle.

The body of the nozzle is designed to slide along the internal face of the plunger body.

This second embodiment of the invention lends itself to the manufacture of mini-pumps known as "spray mini-pumps" for handbags, samples, . . . , but also to the manufacture of pumps capable of dispensing larger metered quantities of liquids or more viscous products such as lotions or creams.

In the case of this second embodiment, the plunger has an annular seal on its internal face, which moves into abutment with the external periphery of the nozzle body in order to isolate the metering chamber from the connecting orifice or from the internal part of the receptacle.

By virtue of another feature of this second embodiment, the metering chamber is bounded at its top part by the internal face of the plunger body and by the external face of the nozzle body and is designed to be placed in communication with the internal part of the receptacle via a cross-passage orifice pierced through the nozzle body, on the one hand, and, on the other, with the connecting orifice and the ejection orifice via a longitudinal dispensing groove provided on the external face of the nozzle body at the same level as the passage orifice.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
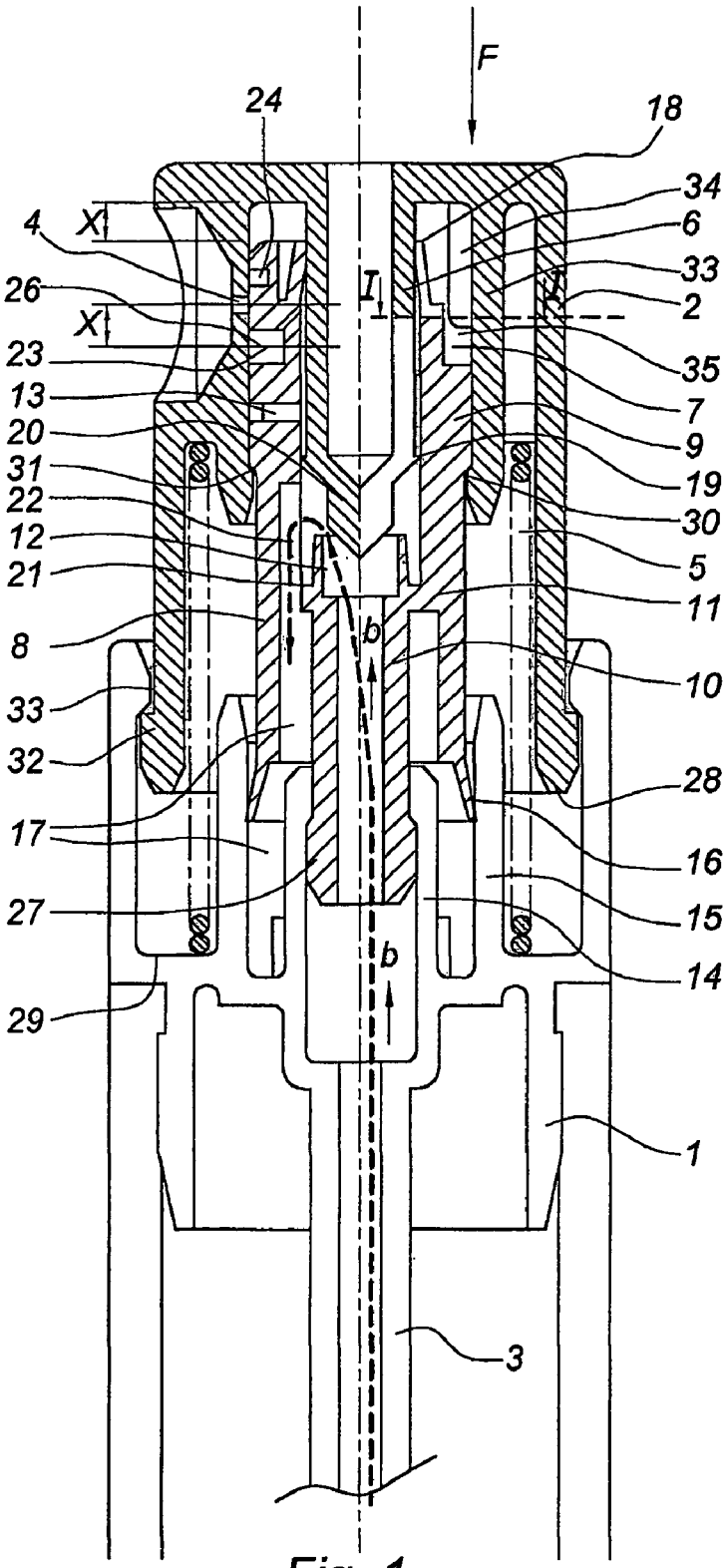
FIG. 1 is a view in section depicting a metering pump corresponding to the first embodiment of the invention, shown in the non-operating position.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PREFERRED EMBODIMENTS

Figure 2:
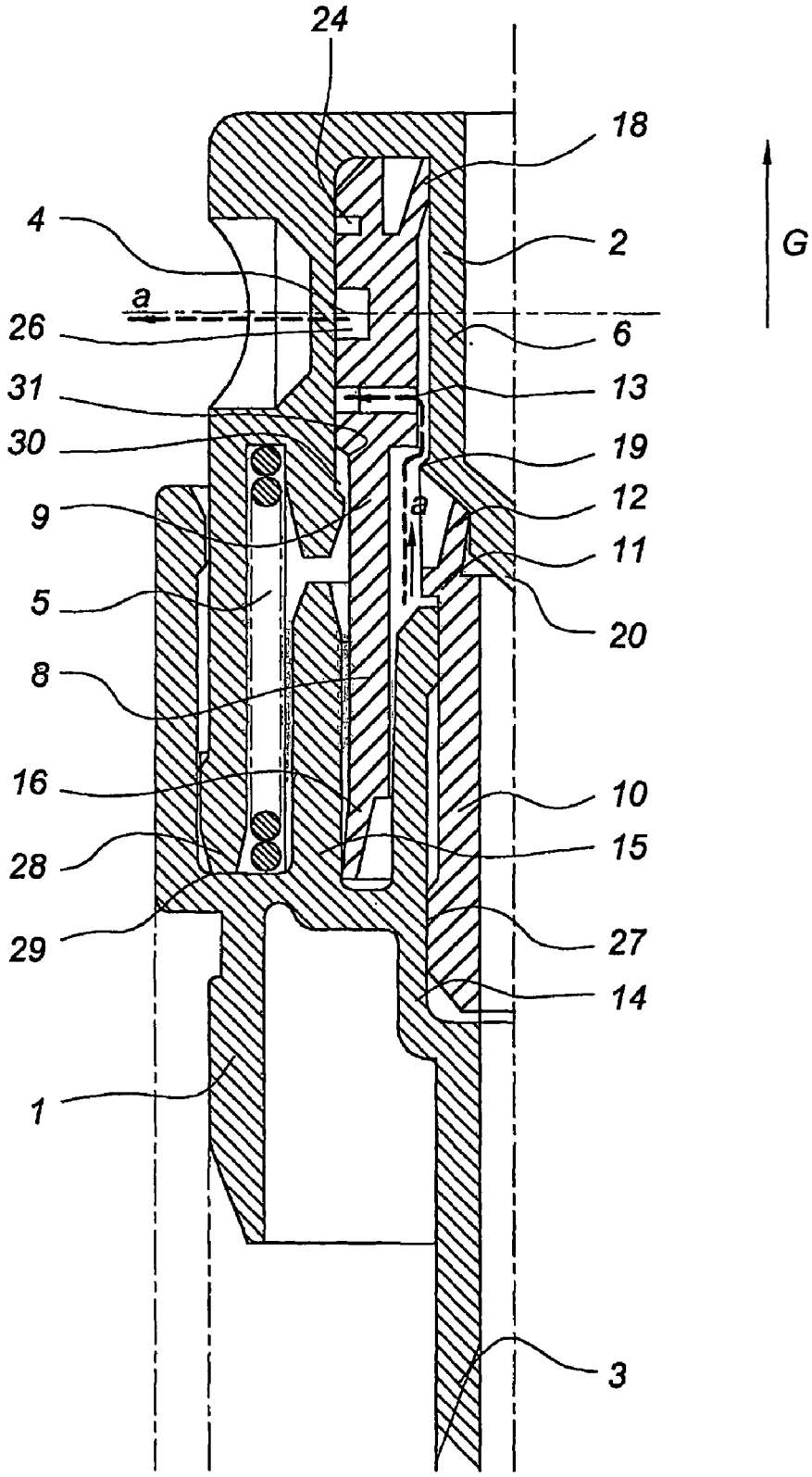
FIG. 2 is a more detailed view corresponding to FIG. 1 but showing the pump in the dispensing position.

The metering pump illustrated in FIG. 1 essentially consists of a tubular pump body 1, which can be adapted to fit on a receptacle, not illustrated, and a push button 2 designed to slide along the internal wall of the pump body 1 between a non-operating position illustrated in FIG. 1 and a dispensing position illustrated in FIG. 2.

The pump body 1 is fitted with a plunger tube 3, enabling the product contained in the receptacle to be drawn in and ejected to the exterior through an ejection orifice 4 provided on a side face of the push button 2, in a manner that will be described in more detail later on in this description.

As illustrated in FIGS. 1 and 2, a return spring 5 is housed between the pump body 1 and the push button 2.

Starting from the non-operating position illustrated in FIG. 1, the user may displace the push button 2 into the dispensing position illustrated in FIG. 2 by applying a pressing force F to the top face thereof.

The spring 5 automatically returns the push button 2 from this dispensing position to the non-operating position illustrated in FIG. 1.

The push button also has an essentially cylindrical median end-piece 6 on its internal part, which is surrounded by an annular recess 7 in which the top end of a plunger 8 is inserted.

As illustrated in FIGS. 1 and 2, the plunger 8 comprises a tubular body 9 inserted in the annular recess 7 of the push button 2 by its top end.

Figure 1A:
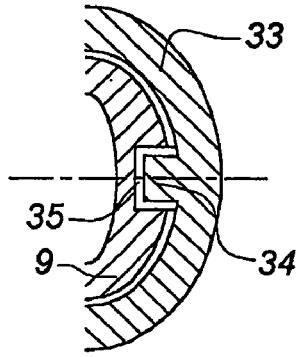
FIG. 1*a* is a view in partial section similar to that of FIG. 1 along a plane denoted by the axis I—I.

As illustrated in FIGS. 1 and 1*a*, the external wall 33 of the annular recess 7 of the push button 2 has a rib 34 forming a key, which co-operates with a matching rib 35 on the tubular body 9 of the plunger 8, so that these two elements rotate integrally as a unit.

The body 9 of the plunger 8 also has a hollow rod 10 at its internal part, which is coaxially affixed to the latter by means of an annular wall 11.

The hollow rod 10 is fitted with an annular seal 12 at its top end.

The body 9 of the plunger 8 in turn has a connecting orifice 13 designed to communicate with the ejection orifice 4 of the push button 2 in a manner that will be described later on in the description.

The rib 34 and the groove 35 ensure that these two orifices 4, 13 are always correctly oriented relative to one another.

As illustrated in FIG. 1, the plunger tube 3 of the pump body 1 is extended in the internal part of the latter by means of a tubular sleeve 14, receiving the bottom end of the hollow rod 10 of the plunger 8.

As illustrated in FIGS. 1 and 2, the outer periphery of the hollow rod 10 has a bead 27 which rubs against the internal wall of the tubular sleeve 14 of the pump body 1 so that it brakes the sliding action of the plunger 8 in the pump body 1 by means of friction.

The tubular sleeve 14 is also surrounded by a collar 15, on the internal face of which an annular seal 16 on the bottom end of the body 9 of the pump 8 is supported.

The tubular sleeve 14 and the collar 15 of the pump body 1 as well as the hollow rod 10 and the bottom part of the body 9 of the plunger 8 therefore bound a metering chamber 17, which is closed by the annular wall 11 at its top part and is kept sealed from the external periphery of the plunger 8 by the annular seal 16.

As illustrated in FIGS. 1 and 2, the return spring 5 is mounted on the pump body 1 to the exterior of the collar 15 and is therefore not in contact with the metering chamber 17.

The top part of the body 9 of the plunger 8 is also fitted with an annular seal 18, which is constantly applied against the periphery of the end piece 6 to guarantee that this end piece and the plunger 8 are sealed at this level.

As illustrated in FIGS. 1 and 2, the median end piece 6 of the push button 2 is also fitted with a circular sealing rib 19 on its periphery, which is supported on the internal face of the body 9 of the plunger 8 so that the metering chamber 17 can be isolated from the connecting orifice 13 in a manner that will be described later on in the description.

The median end piece 6 of the push button 2 also has a locating pin 20 at its bottom end, forming a seat for the annular seal 12 provided on the hollow rod 10 of the plunger 8 to enable the metering chamber 17 to be isolated from the internal part of the receptacle and to do so in a manner that will be described later in the description.

As illustrated in FIG. 1, the annular wall 11 of the plunger 8, which closes off the metering chamber 17 at its top part, has a dispensing orifice 21 pierced through it and opening into a longitudinal dispensing groove 22 provided in the internal wall of the body 9 of the plunger 8.

Figure 3:
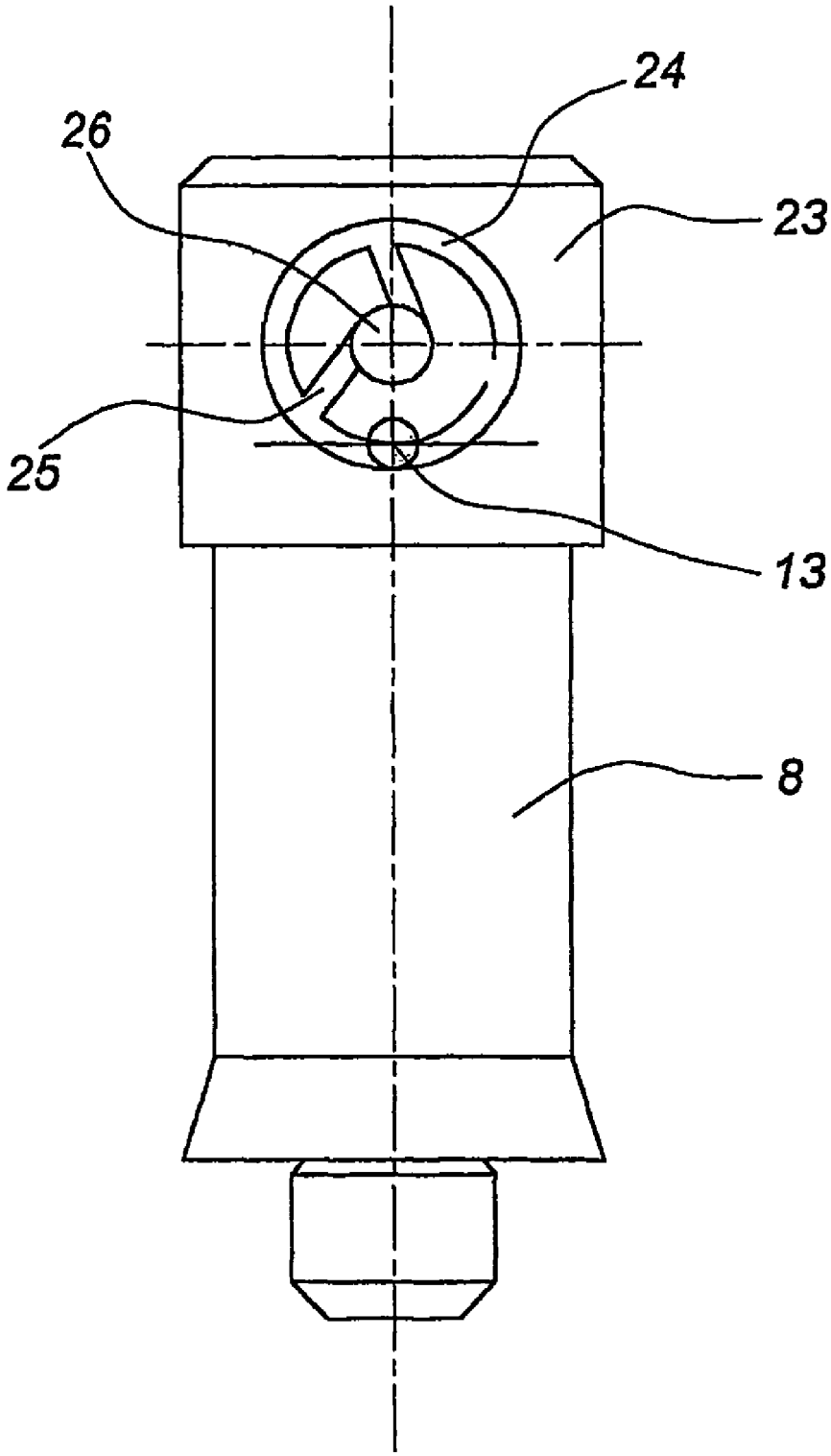
FIG. 3 is a front view of the plunger of this pump, representing the swirl system.

In addition, and as illustrated in FIGS. 1, 2 and 3, the connecting orifice 13 is linked to a swirl system 23 via a circular passage 24, from which rectilinear branches 25 extend, converging on a central passage 26 which can be placed in communication with the ejection orifice 4, as illustrated in FIG. 2, whereas in the non-operating position illustrated in FIG. 1, the ejection orifice 4 is closed off by the body 9 of the plunger 8.

The operating mode of this dispensing pump will now be described with reference to FIGS. 1 and 2.

In the non-operating position illustrated in FIG. 1, the top end of the plunger 8 is disposed at a distance X from the top face of the push button 2 and the metering chamber 17 is filled with a metered quantity of the product to be dispensed.

The axis of the median passage 26 of the swirl system 23 is also located at a distance X from the ejection orifice 4.

In this position, the circular sealing rib 19 of the median end piece 6 of the push button 2 is supported against the internal face of the body 9 of the plunger 8 and the metering chamber 17 is isolated from the connecting orifice 13 and the ejection orifice 4.

The annular seal 12 of the hollow rod 10 of the plunger 8, on the other hand, is not supported on its seat 20 and the metering chamber 17 communicates with the internal part of the receptacle.

Starting from this non-operating position illustrated in FIG. 1, when the user compresses the top face of the push button 2 in the direction of arrow F, this push button is displaced towards the bottom of the drawing inside the pump body 1, whereas the plunger 8 remains immobile and does so until the top face of the push button 2 comes into contact with the top end of the body 9 of the plunger 8, i.e. until the distance X between these two elements becomes zero.

During this displacement, the locating pin 20 moves into abutment with the annular seal 12 of the hollow rod 10 in order to isolate the metering chamber 17 from the internal part of the receptacle and the circular sealing rib 19 of the end piece 6 is simultaneously moved into position facing the dispensing groove 22 of the body 9 of the plunger 8, placing the metering chamber 17 in communication with the connecting orifice 13, whilst the ejection orifice 4 is moved into position alongside the median passage 26 of the swirl system 23.

The metering chamber 17 therefore communicates with the exterior.

As illustrated in FIG. 2, from the point at which the top end of the body 9 of the plunger 8 is in contact with the top face of the push button 2, the user continues to compress this push button in the direction of arrow F, driving the plunger 8 in translation along with it and compressing the metered quantity of product disposed in the metering chamber 17.

Under the effect of this compression, the product enclosed in the metering chamber 17 is ejected to the exterior following the route denoted by a broken line and indicated by the arrows a, passing via the dispensing orifice 21 and via the dispensing groove 22 and along the median end piece 6 of the push button 2 to arrive in the connecting orifice 13, followed by the swirl system 23 and finally through the ejection orifice 4, having passed through the median passage 26.

This ejection continues until the metering chamber 17 has been totally evacuated in the dispensing position illustrated in FIG. 2.

In this position, the bottom end 28 of the push button 2 is in a stop position against an opposing surface 29 of the pump body 1.

From this dispensing position, when the user ceases to compress the push button 2 in the direction of arrow F, the spring 5 automatically returns it towards the top of the drawing in the direction of arrow G.

During a first phase of this movement, because of the presence of the bead 27 which applies a braking action due to friction, the plunger 8 remains immobile so that the locating pin 20 of the push button 2 is released from the annular seal 12 of the hollow rod 10, placing the metering chamber 17 in communication with the internal part of the receptacle.

The circular sealing rib 19 of the end piece 6 is simultaneously released from the dispensing groove 22 and moves back to its position supported against the internal face of the body 9 of the plunger 8 so as to isolate the metering chamber 17 from the connecting orifice 13.

The plunger 8 therefore remains immobile until a shoulder forming a stop 30, provided on the internal face of the push button 2, moves into abutment with a shoulder forming an opposing stop 31 provided on the external face of the body 9 of the plunger 8.

When these two shoulders are in abutment, the top end of the body 9 of the plunger 8 is again disposed at a distance X from the top face of the push button 2.

Starting from this abutment position, the push button 2 drives the plunger 8 with it in translation along the body of the pump 1.

During this movement, the displacement of the plunger 8 relative to the pump body 1 creates a vacuum pressure, causing the product enclosed in the receptacle to be drawn towards the metering chamber 17, as illustrated by broken lines and schematically indicated by arrows b in FIG. 1.

The aspirated product therefore passes through the plunger tube 3 and then through the interior of the tubular sleeve 14 of the pump body, followed by the internal part of the hollow rod 10 and between the annular seal 12 and the locating pin 20 of the end piece 6 of the push button 2 before finally arriving in the metering chamber 17.

The latter is therefore filled with product until opposing surfaces 33 and 32 of the pump body 1 and the push button 2 are moved into abutment with one another so that they are finally in the non-operating position illustrated in FIG. 1.

Figure 4:
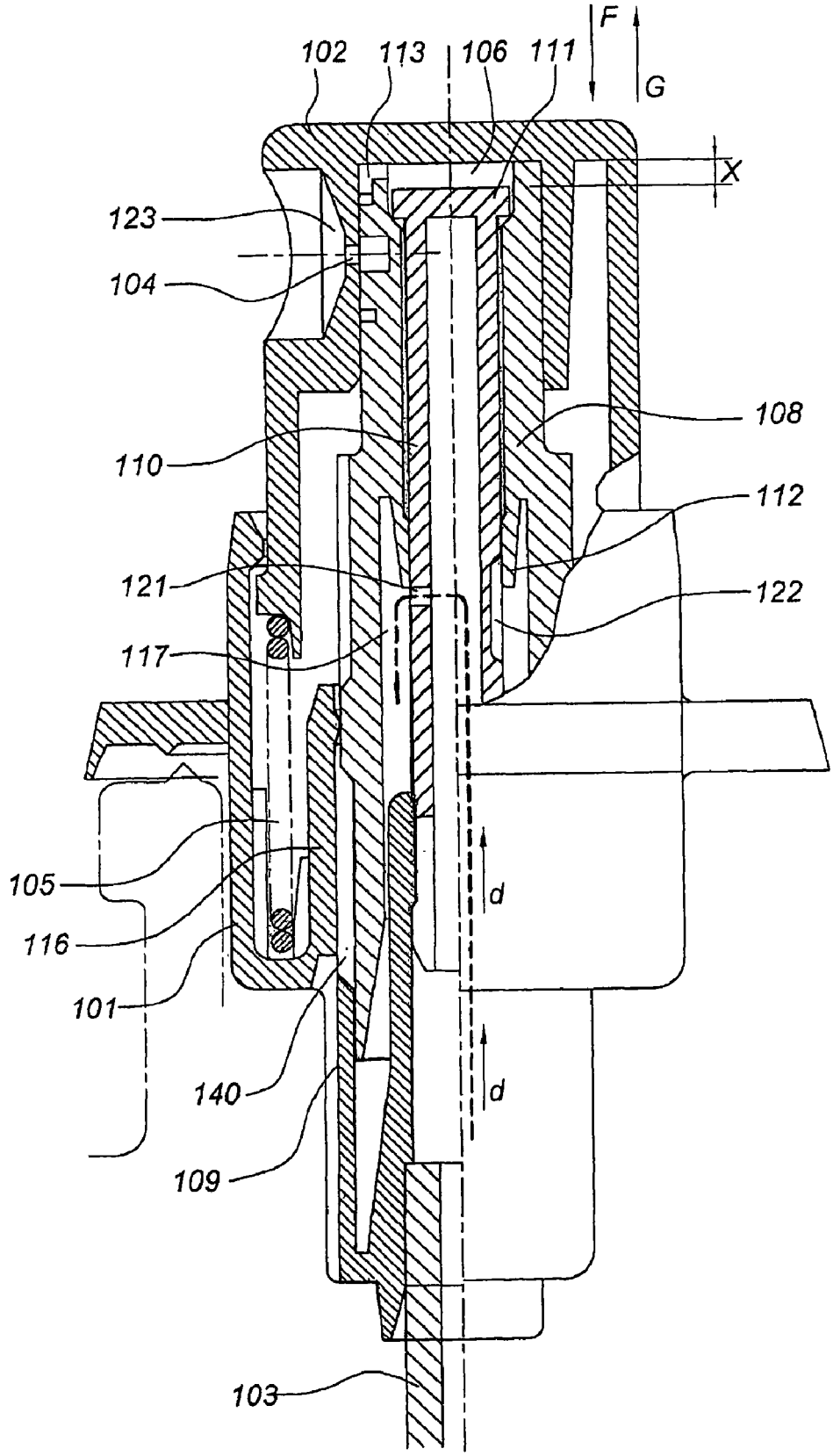
FIG. 4 is a view in section depicting a metering pump corresponding to the second embodiment of the invention and illustrating the non-operating position.
Figure 5:
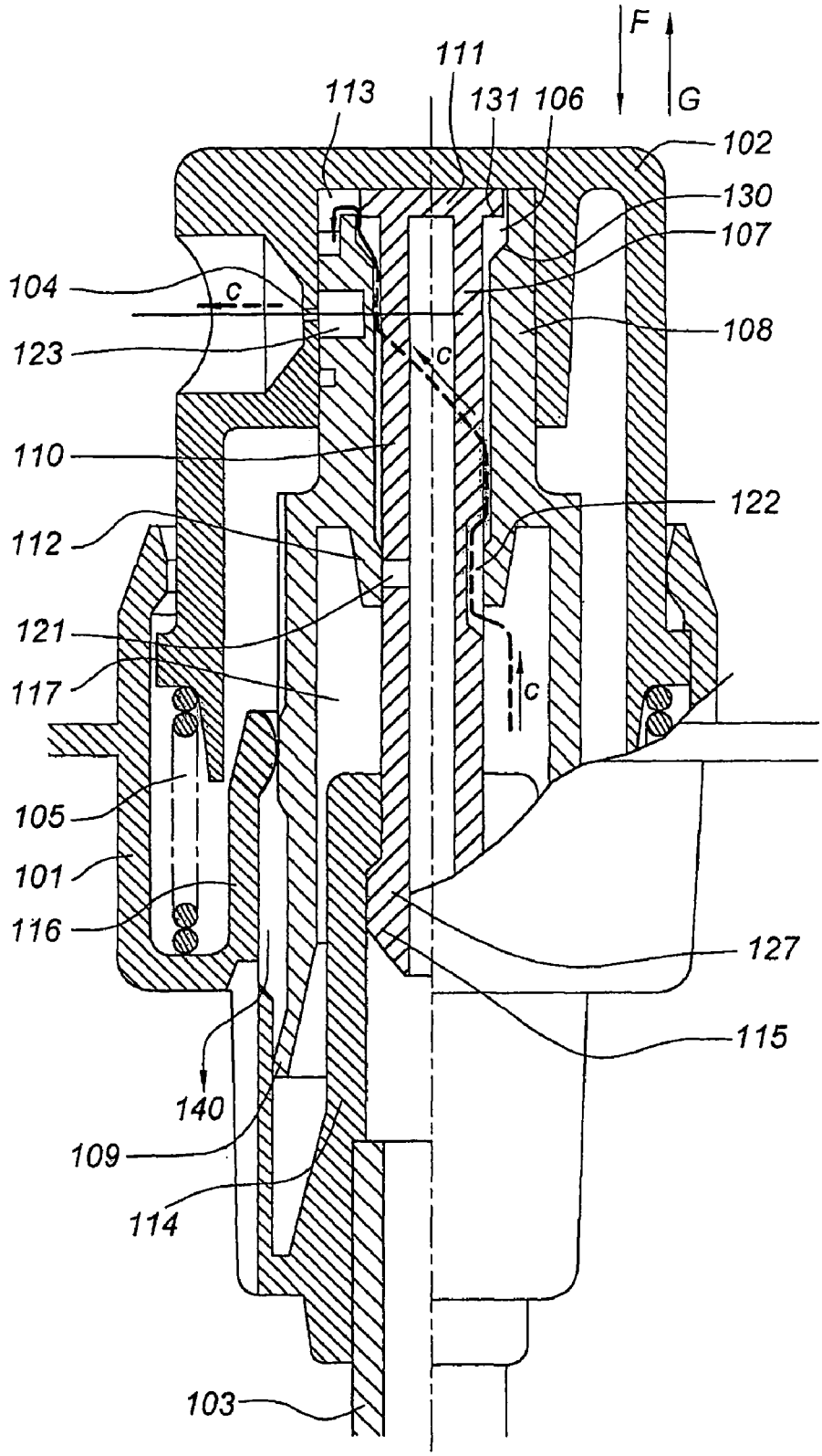
FIG. 5 is a view in section corresponding to FIG. 4 but depicting this same pump in an intermediate position between the non-operating position and the dispensing position.

As illustrated in FIGS. 4 and 5, the metering pump also essentially comprises a tubular pump body 101 which can be adapted to fit a receptacle, as well as a push button 102 designed to slide along the internal wall of the pump body 101 between a non-operating position illustrated in FIG. 4 and a dispensing position, not illustrated.

FIG. 5 illustrates the push button 102 in an intermediate position between the non-operating position and the dispensing position.

The pump body 101 is fitted with a plunger tube 103 enabling the product contained in the receptacle to be aspirated and ejected to the exterior through an ejection orifice 104 disposed on the side face of the push button 102 in a manner that will be described in more detail later on in the description.

In the embodiment illustrated in FIGS. 4 and 5, the pump body 101 also has an exterior air intake 140, which may optionally be dispensed with in certain configurations.

A return spring 105 is housed between the pump body 101 and the push button 102.

This spring 105 automatically returns the push button 102 to the non-operating position illustrated in FIG. 4 when no external constraint is being applied to it.

Starting from this non-operating position, the user may displace the push button 102 towards the bottom of the drawing in the direction of the dispensing position by applying a pressing force F to the top face thereof.

Furthermore, and as illustrated in FIGS. 4 and 5, the push button 102 has a median recess 106 on its internal part, in which the top end of a plunger 108 is fixed, provided in the form of a tubular body.

This plunger 108 is therefore joined to the push button 102 during its displacement between the dispensing position and the non-operating position.

As illustrated in FIGS. 4 and 5, the bottom end of the plunger 108 is fitted with an annular seal 109, which is constantly supported against the internal face of the pump body 101.

The plunger 108 also has a connecting orifice 113 at its top part, which constantly communicates with the ejection orifice 104 of the push button 102 via a swirl system 123, similar to the swirl system 23 incorporated in the metering pump illustrated in FIGS. 1 to 3.

As illustrated in FIGS. 4 and 5, the metering pump also has a nozzle 107, provided in the form of a substantially cylindrical tubular body 110, which is closed at its top end by a circular front wall 111 and open at its bottom end so as to be placed in communication with the internal part of the receptacle.

As illustrated in FIG. 5, the plunger tube 103 is extended inside the pump body 101 by means of a tubular sleeve 114, which receives the bottom end 115 of the tubular body 110 of the nozzle 107 at its internal part.

At this level, the tubular body 110 of the nozzle 107 is provided with an external bead 127 which is designed to rub against the internal wall of the tubular sleeve 114 so as to brake the displacement of the nozzle 107 inside the pump body 101.

Furthermore, and as illustrated in FIGS. 4 and 5, the plunger 108 has an annular seal 112 at its internal periphery, which is supported against the body 110 of the nozzle 107.

As illustrated in these drawings, the tubular sleeve 114, the periphery of the pump body 101, the plunger 108 and the tubular body 110 of the nozzle 107 bound a metering chamber 117.

This metering chamber 117 is hermetically sealed by the annular seal 109 of the plunger 108 and may be isolated from the internal part of the receptacle or the connecting orifice 113 and ejection orifice 104 in a manner that will be described in more detail farther on in the description.

As illustrated in FIGS. 4 and 5, the return spring 105 is in turn mounted on the exterior of a collar 116 of the pump body 101, surrounding the tubular sleeve 114, and is therefore constantly isolated from the metering chamber 117.

The body 110 of the nozzle 107 also has a cross passage 121 pierced through it, on the one hand, and, on the other, a longitudinal dispensing groove 122 in the external face of the nozzle body 110 on the same level as the passage orifice 121.

As will be explained later on in the description, the passage orifice 121 enables the metering chamber 117 to be placed in communication with the internal part of the receptacle, whilst the dispensing groove 122 enables this metering chamber 117 to be placed in communication with the connecting orifice 113 and the ejection orifice 104.

The operating mode of this metering pump will now be described with reference to FIGS. 4 and 5.

In the non-operating position illustrated in FIG. 4, the front wall 111 of the nozzle 107 is located at a distance X from the top face of the push button 102 and the metering chamber 117 is filled with a metered quantity of the product to be dispensed.

In this position, the annular seal 112 of the plunger 108 is supported against the external periphery of the body 110 of the nozzle 107 above the dispensing groove 122 so that the metering chamber 117 is isolated from the connecting orifice 113 and ejection orifice 104.

However, the annular seal 112 does not close off the passage orifice 121, as a result of which the metering chamber 117 communicates with the internal part of the receptacle.

Starting from this non-operating position illustrated in FIG. 4, when the user compresses the top face of the push button 102 as indicated by arrow F, this push button 102 as well as the plunger 108 are displaced towards the bottom of the drawing inside the pump body 101, whilst the nozzle 107 remains immobile, and does so until the position illustrated in FIG. 5 is reached, when the top face of the push button 102 comes into contact with the circular front wall 111 of the nozzle 107, i.e. until the distance X between these two elements becomes zero.

During this displacement, the annular seal 112 moves so that it closes off the passage orifice 121 in order to isolate the metering chamber 117 from the internal part of the receptacle and is simultaneously moved into position facing the dispensing groove 122. The metering chamber is then placed in communication with the connecting orifice 113 and the ejection orifice 104.

Starting from the point at which the circular front wall 111 of the nozzle 107 makes contact with the top face of the push button 102, as the user continues to compress the push button 102 in the direction of arrow F, the nozzle 107 is driven in translation with the plunger 108 and push button 102 and the metered quantity of product disposed in the metering chamber 117 is gradually compressed.

As illustrated in FIG. 5, the product enclosed in the metering chamber 117 is therefore ejected to the exterior along the route indicated by the arrows c, passing via the dispensing groove 122, then around the external wall of the body 110 of the nozzle 107 in order to arrive in the connecting orifice 113, followed by the swirl system 123 and finally the ejection orifice 104.

This ejection continues until the plunger 108 has moved into abutment with the pump body 101, i.e. until the metering chamber 117 has been totally evacuated, in the dispensing position.

From this position, when the user ceases to compress the push button 102 in the direction of arrow F, the spring 105 automatically returns this push button 101 and the plunger 108 towards the top of the drawing as indicated by arrow G.

During a first phase of this displacement, the nozzle 107 remains immobile due to the presence of the friction bead 127; the annular seal 112 is then released from the passage orifice 121, placing the metering chamber 117 in communication with the internal part of the receptacle.

The annular seal 121 is simultaneously moved into abutment with the external periphery of the body 110 of the nozzle 107, being released from the dispensing groove 122, and thus isolates the metering chamber 117 from the connecting orifice 113 and ejection orifice 104.

The nozzle 107 therefore remains immobile until the shoulder acting as a stop 130, provided on the internal face of the plunger 108, is moved into abutment with the shoulder forming an opposing stop 131 provided thereon.

When these two shoulders are in abutment, the circular front wall 111 of the nozzle 107 is again disposed at a distance X from the top face of the push button 102, in the position illustrated in FIG. 4.

From this position, the push button 102 and the plunger 108 drive the nozzle 107 with them in translation along the pump body 101.

During this movement, the displacement of the plunger 108 relative to the pump body 101 creates a vacuum pressure, causing the product enclosed in the receptacle to be drawn towards the metering chamber 117 along a route denoted by broken lines and schematically indicated by arrows d in FIG. 4.

The aspirated product therefore passes through the plunger tube 3, then on the internal part of the body 110 of the nozzle 107, before entering the metering chamber 117 via the passage orifice 121.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A metering pump for use in combination with a receptacle, said receptacle including an interior which contains one of a cosmetic and a pharmaceutical product, said pump comprising:

a pump body, said pump body defining an interior chamber;

a movable push button slidably associated with said body, said push button having a dispensing position and a non-dispensing position, said push button including an ejection orifice and a substantially cylindrical interior portion which is surrounded by an annular recess, said cylindrical interior portion including a circular sealing rib, and a locating pin;

a plunger including a tubular body, said tubular body including an annular seal, said plunger operatively connected to said push button, said tubular plunger body and pump body defining a metering chamber, said plunger slidably movable relative to said pump body whereby, when said push button is moved into said dispensing position, said metering chamber communicates with said ejection orifice and said annular seal isolates said metering orifice from said receptacle interior, and, when said push button is placed in said non-dispensing position, said sealing rib abuts said tubular plunger body and isolates said metering chamber from said ejection orifice;

a return spring disposed between said pump body and said push button; and a friction brake operatively disposed between said plunger and said pump body for frictionally braking relative movement between said plunger and said pump body, whereby in said non-dispensing position of said push button vacuum pressure is created in said metering chamber to enable a metered quantity of product to be drawn into said metering chamber.

2. The pump of claim 1 further comprising a connection orifice connecting said metering chamber with said ejection orifice in the dispensing position of said push button, said plunger including an annular wall surrounding said tubular body, a dispensing groove and a dispensing orifice disposed in said annular wall, said dispensing orifice connecting said metering chamber with said dispensing groove.

3. The pump of claim 1 wherein said ejection orifice is isolated from said metering chamber by the tubular plunger body in the non-dispensing position of said push button.

4. A metering pump for use in combination with a receptacle, said receptacle including an interior which contains one of a cosmetic and a pharmaceutical product, said pump comprising:

a pump body, said pump body defining an interior chamber;

a movable push button slidably associated with said body, said push button having a dispensing position and a non-dispensing position, said push button including an ejection orifice and a substantially cylindrical interior portion which is surrounded by an annular recess;

a plunger having a body including a tubular portion, said tubular portion closed at a top end and open at a bottom end for communication with said receptacle, said plunger having an internal face with an annular seal disposed thereon, said plunger operatively connected to said push button, said plunger body defining a metering chamber, said plunger slidably movable relative to said pump body whereby, when said push button is placed in said non-dispensing position, said annular seal moves into abutment with an external periphery of said tubular portion and isolates said metering chamber from said ejection orifice and from said interior;

a return spring disposed between said pump body and said push button; and a friction brake operatively disposed between said plunger and said pump body for frictionally braking relative movement between said plunger and said pump body, whereby in said non-dispensing position of said push button vacuum pressure is created in said metering chamber to enable a metered quantity of product to be drawn into said metering chamber.

5. The metering pump of claim 4 wherein said top portion of said metering chamber is bounded by an internal face of said plunger body and by an external face of said tubular portion, said tubular portion including an orifice adapted to interconnect a said interior with said metering chamber in said non-dispensing position of said push button and to interconnect said metering chamber with said ejection orifice in the dispensing position of said push button.

* * * * *